US011303007B2

(12) United States Patent
Hirabayashi et al.

(10) Patent No.: US 11,303,007 B2
(45) Date of Patent: Apr. 12, 2022

(54) GLASS WINDOW FOR VEHICLE

(71) Applicant: CENTRAL GLASS COMPANY, LIMITED, Ube (JP)

(72) Inventors: Kanya Hirabayashi, Matsusaka (JP); Shin Kitagawa, Matsusaka (JP)

(73) Assignee: CENTRAL GLASS COMPANY, LIMITED, Ube (JP)

( * ) Notice: Subject to any disclaimer, the term of this patent is extended or adjusted under 35 U.S.C. 154(b) by 39 days.

(21) Appl. No.: 16/966,244

(22) PCT Filed: Mar. 11, 2019

(86) PCT No.: PCT/JP2019/009820

§ 371 (c)(1),
(2) Date: Jul. 30, 2020

(87) PCT Pub. No.: WO2019/181623

PCT Pub. Date: Sep. 26, 2019

(65) Prior Publication Data

US 2021/0050646 A1 Feb. 18, 2021

(30) Foreign Application Priority Data

Mar. 22, 2018 (JP) ..... JP2018-055322

(51) Int. Cl.
*H01Q 1/12* (2006.01)
*H01Q 1/48* (2006.01)

(52) U.S. Cl.
CPC ..... *H01Q 1/1271* (2013.01); *H01Q 1/48* (2013.01)

(58) Field of Classification Search
CPC ..... H01Q 1/1271; H01Q 1/32; H01Q 1/48–52
See application file for complete search history.

(56) References Cited

U.S. PATENT DOCUMENTS 7,019,700 B2 3/2006 Fujii et al.
2007/0097000 A1 5/2007 Sugimoto et al.
(Continued)

FOREIGN PATENT DOCUMENTS

CN 102971907 A 3/2013
CN 106558752 A 4/2017
(Continued)

OTHER PUBLICATIONS

Office Action dated Dec. 24, 2020, issued in counterpart CN Application No. 201980012594.9, with English machine translation. (17 pages).
(Continued)

*Primary Examiner* — Hasan Islam
(74) *Attorney, Agent, or Firm* — Westerman, Hattori, Daniels & Adrian, LLP

(57) ABSTRACT

It is provided a glass window for a vehicle, comprising: an antenna configured to receive a radio wave; and a noise rejecting pattern configured to absorb noise that reaches the antenna, wherein, an electronic device configured to acquire information outside the vehicle through the glass window is mounted on or close to the glass window, wherein the noise rejecting pattern includes a first conductor coupled to a vehicle body for giving an earth potential at a high frequency, and a second conductor extending from the first conductor to exist between the antenna and the electronic device, and wherein the second conductor is placed closer to the antenna than to the electronic device.

9 Claims, 2 Drawing Sheets

(56) References Cited

U.S. PATENT DOCUMENTS

| | | | | |
|---|---|---|---|---|
| 2012/0256798 | A1 | 10/2012 | Paulus et al. | |
| 2016/0134013 | A1 | 5/2016 | Suenaga et al. | |
| 2016/0269059 | A1* | 9/2016 | Funatsu | H04B 1/126 |
| 2018/0062253 | A1* | 3/2018 | Shukutani | H01Q 1/1271 |
| 2018/0090811 | A1* | 3/2018 | Kagaya | H01Q 1/325 |
| 2020/0052366 | A1 | 2/2020 | Nagata et al. | |

FOREIGN PATENT DOCUMENTS

| | | | |
|---|---|---|---|
| EP | 2581983 | A1 | 4/2013 |
| JP | 2000-174529 | A | 6/2000 |
| JP | 2004-260504 | A | 9/2004 |
| JP | 2007-124235 | A | 5/2007 |
| JP | 2015-95794 | A | 5/2015 |
| JP | 2016-63416 | A | 4/2016 |
| WO | 2015/019904 | A1 | 2/2015 |
| WO | 2018/079415 | A1 | 5/2018 |

OTHER PUBLICATIONS

Office Action dated May 28, 2021, issued in counterpart CN Application No. 201980012594.9, with English machine translation. (15 pages).

International Search Report dated Apr. 9, 2019, issued in counterpart International Application No. PCT/JP2019/009820, with English Translation. (3 pages).

Extended (Supplementary) European Search Report dated Nov. 10, 2021, issued in counterpart EP Application No. 19771775.4. (11 pages).

* cited by examiner

GLASS WINDOW FOR VEHICLE

BACKGROUND OF THE INVENTION

This invention relates to a glass window for a vehicle on which an antenna is placed, and more particularly, to a technology of reducing noise induced in the antenna.

In a vehicle, a sensor for acquiring various states outside the vehicle through a glass window is attached to the glass window, or at a position close to the glass window. For instance, an anti-collision sensor or a driving assistance system is mounted on an automobile in order to enhance safety, and a sensor for acquiring states outside the vehicle, for example, a CCD camera, a CMOS camera, a near-infrared laser transceiver, an ultrasonic transceiver, and/or a millimeter wave transceiver, is provided for the anti-collision sensor or the driving assistance system.

A glass antenna is provided to the glass window of the automobile as well for improvement of the design of the automobile and the prevention of the breakage of a pole antenna. With the devices described above and the glass antenna placed close to each other, noise from those devices affect the glass antenna.

Background art in this technical field includes JP 2015-95794 A and JP 2016-63416 A. In JP 2015-95794 A, there is described a glass window for an automobile, in which the influence of noise generated by a sensor over the antenna is reduced by a conductive pattern coupled to the vehicle body through direct-current coupling or capacitive coupling. In JP 2016-63416 A, there is disclosed a noise rejection mechanism, which suppresses the propagation of noise generated in a radar apparatus to the antenna.

SUMMARY OF THE INVENTION

However, the noise rejection mechanisms of the related art have complicated structures, which cause a rise in manufacturing cost. The noise rejection mechanisms are also insufficient in terms of noise rejection characteristics in a reception frequency band of the antenna, and accordingly require performance improvement.

An object of this invention is to provide a high-performance noise rejecting pattern having a simple configuration.

That is, according to at least one embodiment of this invention, there is provided a glass window for a vehicle, comprising: an antenna configured to receive a radio wave; and a noise rejecting pattern configured to absorb noise that reaches the antenna, wherein, an electronic device configured to acquire information outside the vehicle through the glass window is mounted on or close to the glass window, wherein the noise rejecting pattern includes a first conductor coupled to a vehicle body for giving an earth potential at a high frequency, and a second conductor extending from the first conductor to exist between the antenna and the electronic device, and wherein the second conductor is placed closer to the antenna than to the electronic device.

Further, in the glass antenna according to the one embodiment of this invention, the antenna comprises a core-side feeding unit, a core-side element extending from the core-side feeding unit, an earth-side feeding unit, and an earth-side element extending from the earth-side feeding unit.

Further, in the glass antenna according to the one embodiment of this invention, the first conductor is placed in a place existing along a body flange of a vehicle body, to which the glass window is attached, and the second conductor extends downward from an end part of the first conductor.

Further, in the glass antenna according to the one embodiment of this invention, the second conductor includes a plurality of wires, which have different lengths, and are arranged substantially parallel to one another.

Further, in the glass antenna according to the one embodiment of this invention, the electronic device is mounted on the glass window for a vehicle.

Further, in the glass antenna according to the one embodiment of this invention, a length of the first conductor and a length of the second conductor are defined by Expression (1):

$$LA/(\alpha\times\beta)+LB/\alpha=n\times\lambda/2 \quad (1)$$

where LA represents the length of the first conductor, LB represents the length of the second conductor, $\lambda$ represents a wavelength of any one frequency selected from a desired noise rejection frequency band, $\alpha$ represents a wavelength shortening rate of glass, $\beta$ represents a wavelength shortening rate of an adhesive, and n represents any natural number.

Further, in the glass antenna according to the one embodiment of this invention, the length of the second conductor is defined by $\alpha\lambda/4$, where $\lambda$ represents the wavelength of any one frequency selected from the desired noise rejection frequency band, and $\alpha$ represents the wavelength shortening rate of glass.

According to the exemplary embodiments of this invention, high noise attenuation characteristics can be obtained in a desired band. In addition, it is only required to adjust the shape (mainly the length) of the second conductor in accordance with a reception frequency band of the antenna, and the combination of the antenna and the noise rejecting pattern can therefore be compact in size.

BRIEF DESCRIPTION OF THE DRAWINGS

The present invention can be appreciated by the description which follows in conjunction with the following figures, wherein.

DETAILED DESCRIPTION OF THE PREFERRED EMBODIMENTS

Figure 1:
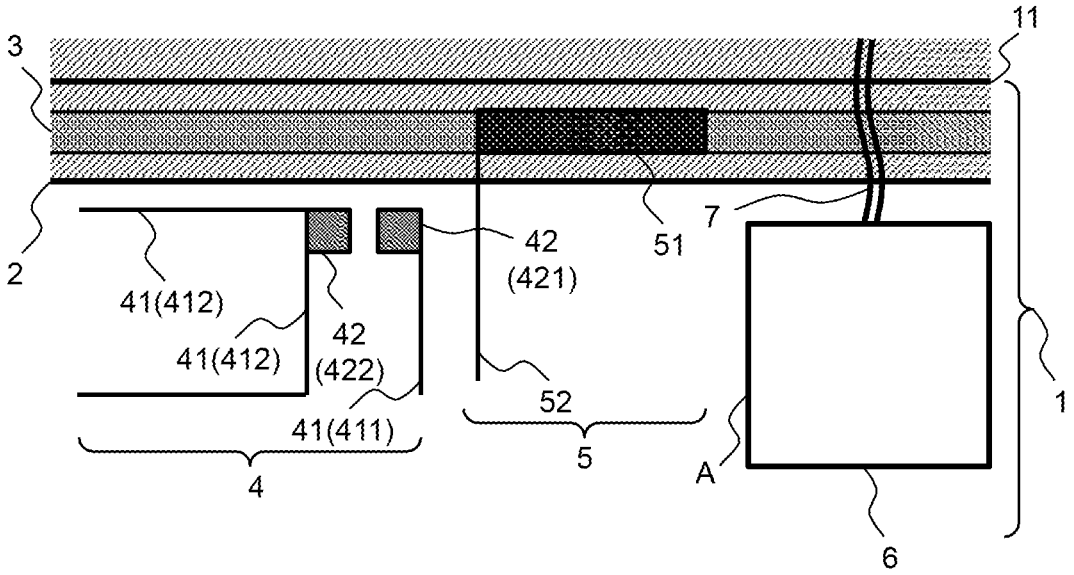
FIG. 1 is a plan view of a glass window for a vehicle according to a first embodiment of this invention.
Figure 2:
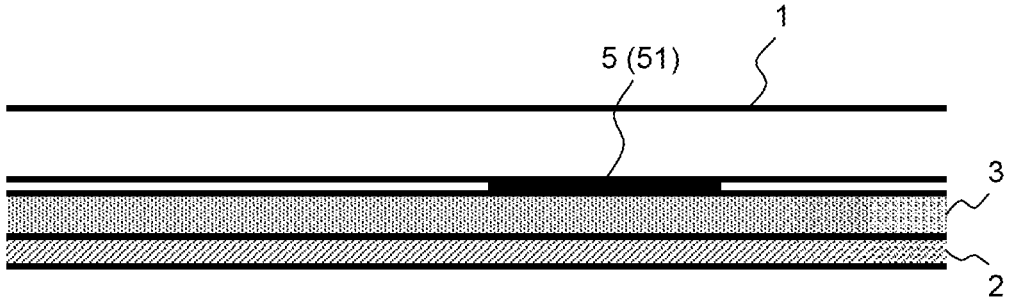
FIG. 2 is a cross-sectional view of the glass window for a vehicle according to a first embodiment of this invention in which the glass window is attached to a vehicle body.
Figure 3:
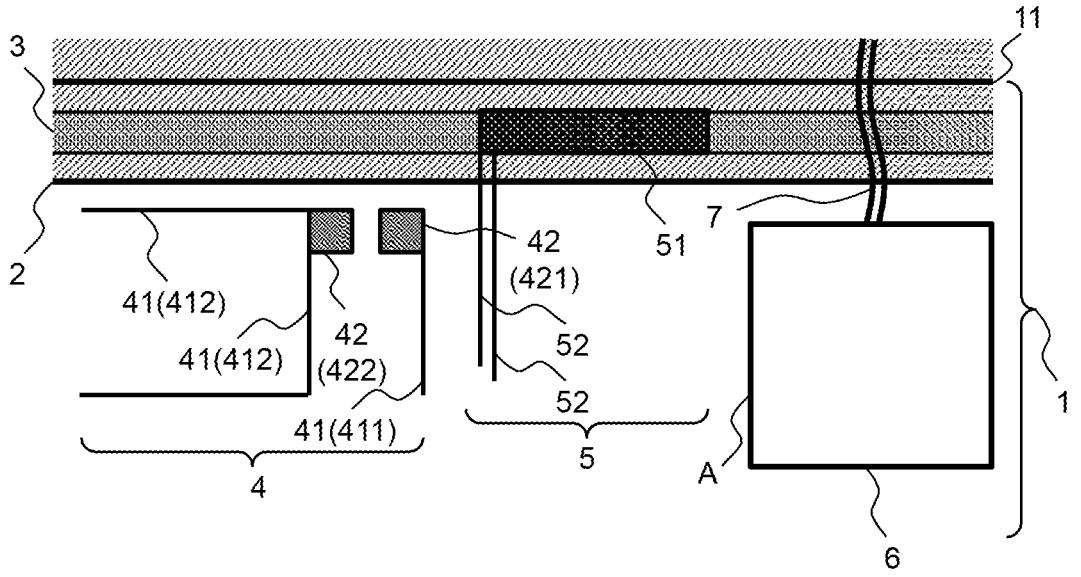
FIG. 3 is a plan view of a glass window for a vehicle according to a first embodiment of this invention.

FIG. 1 and FIG. 3 are each a plan view of a glass window for a vehicle according to at least one embodiment of this invention that is viewed from the interior of the vehicle. FIG. 2 is a cross-sectional view of the glass window for a vehicle according to a first embodiment of this invention in which the glass window is attached to a vehicle body.

In the first embodiment and a second embodiment of this invention, a glass window 1 for a vehicle is attached to a vehicle body 2 of the vehicle with an adhesive 3. An antenna 4, a noise rejecting pattern 5, and an electronic device 6 are attached to the glass window 1. The antenna 4 is, for example, an antenna configured to receive a digital television broadcast wave, and includes a pattern forming an element and a power feeding unit, which are provided at positions close to an upper side of the glass window.

The electronic device 6 is provided on the glass window 1. The electronic device 6 is configured to emit noise when in operation, and noise is emitted also from a cable coupled to the electronic device 6. It is therefore desired to arrange the electronic device 6 and the cable 7 apart from the antenna 4. However, the electronic device 6 is a device for monitoring the space ahead of the vehicle, and hence the electronic device 6 is provided on an upper part of the glass window 1 that is a front windshield and cannot avoid being close to the antenna 4 in some cases.

The noise rejecting pattern 5 includes a first conductor 51, which is wide and provided on the vehicle body 2 in a hidden place, and one or a plurality of second conductors 52, which extend downward from the first conductor 51. The first conductor 51 is in contact with the vehicle body 2 via a layer of the adhesive 3, and is therefore provided at a position overlapping with the vehicle body 2 (closer to the vehicle body than to a body flange 2) so as to reach an earth potential at a high frequency through capacitive coupling to the vehicle body 2. The adhesive 3 may be a non-conductive adhesive or a conductive adhesive.

In at least one embodiment of this invention, examples of a desired noise rejection frequency band include a frequency band of from 470 MHz to 710 MHz, which can be used in digital television broadcasting, a frequency band of from 174 MHz to 240 MHz, which can be used for broadcast waves of Digital Audio Broadcasting, a frequency band of from 1.2 GHz to 1.6 GHz, which can be used for GPS satellite waves and others, ITS bands for ETC and others, and a frequency band of from 4 GHz to 6 GHz, which can be used for vehicle-to-vehicle communication waves, 5 G communication, and others.

First Embodiment

Embodiments of this invention are described next. As illustrated in FIG. 1, the glass window 1 for a vehicle according to the first embodiment is attached to the vehicle body 2 of the vehicle with the adhesive 3. An upper edge of the glass window 1 is represented by a line 11, and a leader line having the reference numeral "2" indicates the position of the body flange.

The antenna 4, the noise rejecting pattern 5, and the electronic device 6 are attached to the glass window 1. The electronic device 6 is coupled by the cable 7 to an electronic circuit (for example, ECU) on the vehicle body side. The antenna 4 is, for example, an antenna configured to receive a digital television broadcast wave, and includes a pattern forming an element 41 and a power feeding unit 42, which are provided at positions close to the upper side of the glass window. The power feeding unit 42 includes a core-side feeding unit 421 and an earth-side feeding unit 422. The element 41 includes a core-side element 411 extending from the core-side feeding unit 421 and an earth-side element 412 extending from the earth-side feeding unit 422. In the illustrated example, the core-side element 411 is placed on the side on which the electronic device 6 and the cable 7 (a noise source) are located. The earth-side element 412, however, may be placed on the side on which the electronic device 6 and the cable 7 (a noise source) are located. Although an antenna configured to receive a digital television broadcast wave is illustrated as the antenna 4 in FIG. 1, the antenna 4 may be an antenna configured to receive other radio waves (a broadcast wave of Digital Audio Broadcasting, a vehicle-to-vehicle communication wave, a communication wave for the highway advisory information radio, a GPS satellite wave, and the like). The antenna 4 may also be an antenna for cellular phone communication or other types of mobile communication.

The electronic device 6 is provided on the glass window 1. The electronic device 6 is, for example, a sensor (a CCD camera, a CMOS camera, a near infrared laser transceiver, an ultrasonic transceiver, a millimeter wave transceiver, or the like) for acquiring information outside the vehicle, or an electronic circuit of an anti-collision system or a driving assistance system for enhancing safety. The electronic device 6 is provided typically on the glass window 1 in a middle part widthwise, at a position that is 50 mm to 200 mm from an upper body flange, but may be provided close to the glass window 1. The cable 7 coupled to the electronic device 6 extends typically upward so as not to obstruct the view of an occupant of the vehicle.

The noise rejecting pattern 5 includes the first conductor 51, which is wide and provided on the vehicle body 2 in a hidden place, and the second conductor 52, which extends from the first conductor 51 downward (desirably, substantially in a normal direction of the body flange 2). The first conductor 51 is placed along the body flange, to thereby broaden the area of a part of the first conductor 51 that is placed close to the vehicle body 2, which ensures that the electric potential of the first conductor 51 reaches the earth potential. The second conductor 52 is placed so as to exist between the antenna 4 and the electronic device 6 or the cable 7. The second conductor 52 accordingly absorbs noise traveling from the electronic device 6 or the cable 7 toward the antenna 4, and noise reaching the antenna 4 can thus be reduced.

The first conductor 51 is desirably formed wide in order to broaden the area of a part of the first conductor 51 that is placed close to the vehicle body 2. When the first conductor 51 is wide, however, the resonance frequency drops, which means that the length of the first conductor 51 is required to be shortened. The Q-value also drops when the first conductor 51 is wide. Consequently, the first conductor 51 that is wide weakens resonance but enables the expansion of a frequency range in which noise can be rejected.

A front surface of the first conductor 51 may be a conductor (so-called solid pattern) or may have wires formed into a lattice pattern or a mesh pattern. The lattice pitch is desired to be $\lambda/10$ or less. To reduce noise in the frequency band of digital television broadcasting, for example, the lattice pitch is desired to be 30 mm or less in consideration of an upper limit frequency of the frequency band of digital television broadcasting, which is 710 MHz.

The second conductor 52 may extend downward from an end part of the first conductor 51 as illustrated, or may extend downward from around the center of the first conductor 51. The degree of freedom in the choice of shape is high and shapes other than the illustrated letter L shape, for example, a letter T shape, may be chosen because the degree of freedom is high in the arrangement of the second conductor 52 relative to the first conductor 51.

The second conductor 52 may be placed on the side on which the antenna 4 is located, preferably close to the antenna 4. Specifically, the second conductor 52 is preferably placed closer to the antenna than a point at which the distance between the antenna 4 and the electronic device 6 or the distance between the antenna 4 and the cable 7 is bisected. It is also preferred to place the second conductor 52 at a distance that prevents the second conductor 52 from coupling to an element of the antenna 4 and consequently operating as a wave director or an antenna reflector. More specifically, the noise rejecting pattern 5 is preferably placed at a position that is $\alpha\lambda/10$ to $\alpha\lambda/4$, where $\alpha$ represents the wavelength shortening rate of glass, from the power feeding unit of the antenna 4. Part of the energy of noise emitted from the electronic device 6 and the cable 7 is propagated along a surface of the glass plate 1. When the noise is propagated at a low elevation angle with respect to the glass plate 1, the energy of the propagated noise is large. The noise rejecting pattern 5 therefore has a high noise rejection effect when placed close to the power feeding unit of the antenna 4.

The noise rejecting pattern 5 may be placed at a position that is $\alpha\lambda/10$ to $\alpha\lambda/4$ from a side surface A of the electronic device 6 on the side on which the noise rejecting pattern 5 is located, or from the cable 7. When the noise rejecting pattern 5 is placed close to a noise source (the electronic device 6 or the cable 7), noise tends to be absorbed by the second conductor 52, which has a low electric potential, with the result that a satisfactory noise rejection effect is obtained.

As illustrated in FIG. 2, the noise rejecting pattern 5 (the first conductor 51) is provided on the glass window 1, specifically, between the glass substrate 1 and the layer of the adhesive 3.

The first conductor 51 is in contact with the vehicle body 2 via the layer of the adhesive 3, and is therefore provided at a position overlapping with the vehicle body 2 (closer to the vehicle body than to the body flange 2) so as to reach an earth potential at a high frequency through capacitive coupling to the vehicle body 2. A conductive adhesive may be used to establish direct-current conduction between the first conductor 51 and the vehicle body 2. When a conductive adhesive is used as the adhesive 3, it is preferred to adjust the size of the first conductor 51 and characteristics of the adhesive 3 so that the contact resistance of the first conductor 51 is 50Ω or less.

When the first conductor 51 is provided in a place to which the adhesive 3 is applied, the distance between the first conductor 51 and the vehicle body 2 is stabilized, and desired noise rejection performance is consequently exerted. The first conductor 51 may be provided between the place to which the adhesive 3 is applied and the body flange 2, or between the place to which the adhesive 3 is applied and an edge part 11 of the glass window 1.

In the mode illustrated in FIG. 2, the noise rejecting pattern 5 is formed on a surface of the glass window 1. When the glass window 1 is made of laminated glass, however, the noise rejecting pattern 5 may be formed on an inner layer of the glass window 1.

The conductors 51 and 52 of the noise rejecting pattern 5 are formed by printing a conductive ceramic paste in a given width on a glass surface, drying the paste, and then baking the paste in a heating furnace. A conductor forming the antenna 4 (wires and the power feeding unit) is formed by printing the wires each having a width of approximately 0.7 mm on a glass surface with a conductive ceramic paste, drying the paste, and then baking the paste in a heating furnace. The antenna conductor may be formed from a conductive pattern formed on a light-transmissive resin film, and the resin film with the antenna conductor formed thereon may be attached to the glass plate.

The noise rejecting pattern 5, which is provided on a glass window that is a front windshield in the example described above, may be provided on a glass window that is a rear windshield. The noise rejecting pattern may also be provided on a glass window that is a side window when a sensor or a similar device that is a noise source is mounted on the side window.

The length of the first conductor 51 and the second conductor 52 is described next. To reduce noise in the frequency band of digital television broadcasting, the size of the noise rejecting pattern 5 is desired to be contained within 150 mm along the body flange 2 and 150 mm in the normal direction of the body flange. Specifically, the length of the first conductor 51 and the second conductor 52 differs when the adhesive 3 is conductive and when the adhesive 3 is non-conductive.

First, when the adhesive 3 is non-conductive, the noise rejecting pattern 5 is not earthed in terms of direct current, which means that an end part of the noise rejecting pattern 5 is a free end, and resonance at $\lambda/2$ is accordingly preferred. Specifically, when the length of the first conductor 51 is represented by LA, the length of the second conductor 52 is represented by LB, a lower limit wavelength of a desired noise rejection frequency band is represented by $\lambda$, the wavelength shortening rate of glass is represented by $\alpha$, and the wavelength shortening rate of the adhesive is represented by $\beta$, the sum of the length of the first conductor 51 and the length of the second conductor 52 can be expressed by Expression (2).

$$LA/(\alpha\times\beta)+LB/\alpha=n\times\lambda/2 \quad (2)$$

In Expression (2), n represents any natural number. The noise rejecting pattern 5 does not significantly vary in characteristics when the size of the noise rejecting pattern 5 is within a tolerance of approximately ±10% of Expression (2).

When the second conductor 52 extends downward from around the center of the first conductor 51, the length of the first conductor 51 and the second conductor 52 is the sum of a longer length, of lengths from a connection point at which the second conductor 52 and the first conductor 51 are coupled to the end parts of the first conductor 51, and the length of the second conductor 52. The sum length is only required to satisfy Expression (2).

When the adhesive 3 is conductive, on the other hand, the noise rejecting pattern 5 is earthed in the first conductor 51 (namely, one end of the pattern), and resonance at $\lambda/4$ is accordingly preferred. In other words, the first conductor 51 is given the same electric potential as that of the vehicle body 2 through conduction to the vehicle body 2, and accordingly stops resonating at a high frequency, resulting in a loss of the effect. Specifically, the length of the second conductor 52 is desired to be $\alpha\lambda/4$ in the desired noise rejection frequency range, and there is no significant variation in characteristics when the length of the second conductor 52 is within a tolerance of approximately ±20%.

In the first embodiment, the noise rejecting pattern 5 is thus configured so as to have frequency characteristics, and a large proportion of noise at desired frequencies can accordingly be absorbed.

Second Embodiment

FIG. 3 is a plan view of a glass window for a vehicle according to the second embodiment that is viewed from the interior of the vehicle. In the second embodiment, differences from the first embodiment are mainly described, and description on components described in the first embodiment is omitted by denoting the components with the same reference numerals as those in the first embodiment. Positional relationships of components in the second embodiment are therefore the same as those in the first embodiment, unless otherwise noted.

In the second embodiment, a plurality of second conductors 52 arranged substantially parallel to one another are provided unlike the first embodiment described above. Two second conductors 52 are provided in FIG. 3. However, the number of second conductors 52 may be three or more, and is preferred to be suitably adjusted in relation to noise rejection characteristics. Noise rejection performance can be improved in the second embodiment by providing a plurality of second conductors 52.

The plurality of second conductors 52 may have different lengths. The different lengths of the second conductors 52 cause the resonance frequency of the second conductors 52 to vary, with the result that the noise rejection effect is obtained in a wide frequency band.

The arrangement interval between the plurality of second conductors 52 is desired to be from about 5 mm to about 10 mm. This is because the noise rejection effect decreases in both of a case in which the plurality of second conductors 52 are arranged close to one another to form strong coupling that causes the second conductors 52 to function as one conductor and a case in which the plurality of second conductors 52 are spaced apart and the resonance relationship of the noise rejecting pattern 5 is dissolved.

Figure 4:
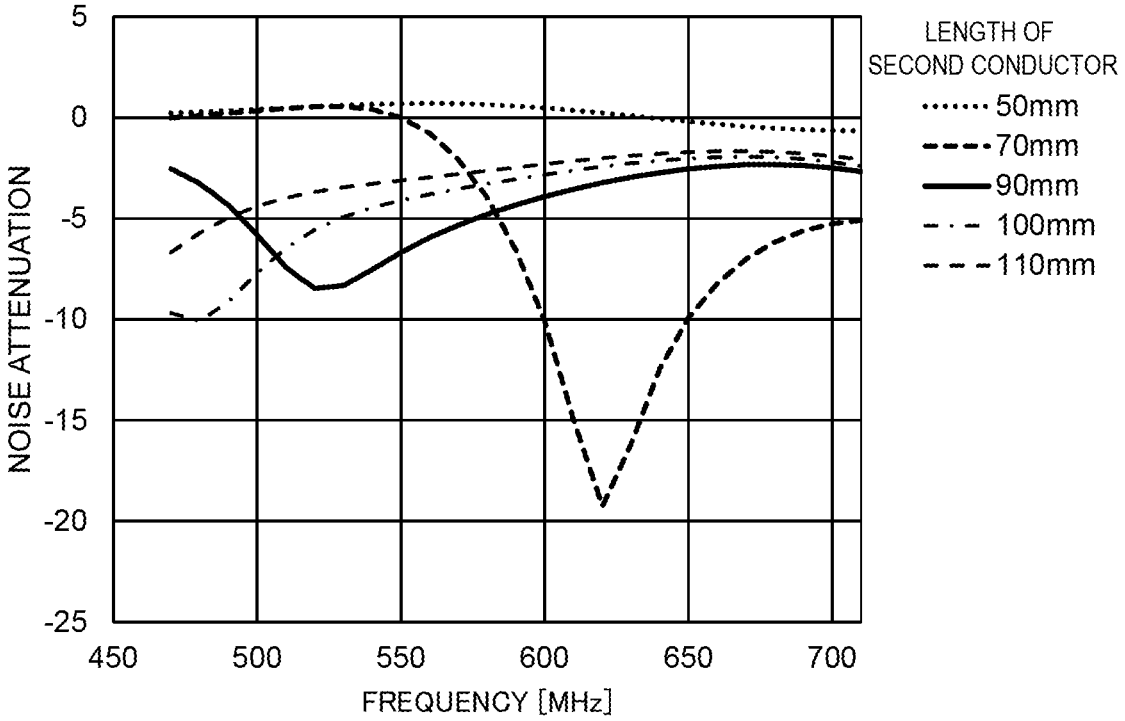
FIG. 4 is a view of showing noise rejection characteristics in the first embodiment.

FIG. 4 is a graph for showing noise rejection characteristics in the first embodiment. In FIG. 4, characteristics of the noise rejecting pattern in the first embodiment and characteristics of a variation mode in the frequency band of digital television broadcasting are shown.

As shown in FIG. 4, with the second conductor 52 that has a length of 90 mm, a noise attenuation amount increased around 520 MHz and an attenuation amount of −4 dB or more was obtained on a lower frequency side (470 MHz to 600 MHz) of the frequency band of digital television broadcasting.

It is also shown in FIG. 4 that changes in the length of the second conductor 52 to 70 mm, 90 mm, and 100 mm changed the frequency at which the noise attenuation amount was large (the resonance frequency) to 620 MHz, 520 MHz, and 480 MHz, respectively, which indicates that the lengthening of the second conductor 52 causes a drop in frequency at which noise can be attenuated. This also indicates that the lengthening of the second conductor 52 dulls resonance characteristics for noise attenuation, and consequently enables noise rejection in a wide band.

The present application claims priority from Japanese patent application JP 2018-55322 filed on Mar. 22, 2018, the content of which is hereby incorporated by reference into this application.

What is claimed is:

1. A glass window for a vehicle, the glass window comprising:

an antenna configured to receive a radio wave; and a noise rejecting pattern configured to absorb noise that reaches the antenna, wherein, an electronic device configured to acquire information outside the vehicle through the glass window is mounted on or close to the glass window, wherein the noise rejecting pattern includes a first conductor capacitively coupled to a body of the vehicle for giving an earth potential at a high frequency and placed in a place existing along and closer to a body flange of the body of the vehicle to which the glass window is attached, and a second conductor extending downward from the first conductor to exist between the antenna and the electronic device, and wherein the second conductor is placed closer to the antenna than to the electronic device.

2. The glass window for a vehicle according to claim 1, wherein the antenna comprises a core-side feeding unit, a core-side element extending from the core-side feeding unit, an earth-side feeding unit, and an earth-side element extending from the earth-side feeding unit.

3. The glass window for a vehicle according to claim 1, wherein the noise rejecting pattern is formed in an L shape by the second conductor extending downward from an end part of the first conductor.

4. The glass window for a vehicle according to claim 1, wherein the second conductor includes a plurality of wires, which have different lengths, and are arranged substantially parallel to one another.

5. The glass window for a vehicle according to claim 1, wherein the electronic device is mounted on the glass window for the vehicle.

6. The glass window for a vehicle according to claim 1, wherein a length of the second conductor is defined by $\alpha\lambda/4$, where $\lambda$ represents the wavelength of any one frequency, including the high frequency, selected from a desired noise rejection frequency band, and a represents the wavelength shortening rate of glass.

7. The glass window for a vehicle according to claim 1, wherein the noise rejecting pattern is placed on a glass plate and the first conductor of the noise rejecting pattern is placed between the glass plate and an adhesive.

8. The glass window for a vehicle according claim 7, wherein a length of the first conductor and a length of the second conductor are defined by Expression (3):

$$LA/(\alpha\times\beta)+LB/\alpha=n\times\lambda/2 \quad (3)$$

where LA represents the length of the first conductor, LB represents the length of the second conductor, $\lambda$ represents a wavelength of any one frequency selected from a desired noise rejection frequency band, $\alpha$ represents a wavelength shortening rate of the glass plate, $\beta$ represents a wavelength shortening rate of the adhesive, and n represents any natural number.

9. A glass window fora vehicle, the glass window comprising:

an antenna configured to receive a radio wave; and a noise rejecting pattern configured to absorb noise that reaches the antenna, wherein, an electronic device configured to acquire information outside the vehicle through the glass window is mounted on or close to the glass window, wherein the noise rejecting pattern includes a first conductor capacitively coupled to a body of the vehicle for giving an earth potential at a high frequency, and a second conductor extending from the first conductor to exist between the antenna and the electronic device, and wherein the second conductor is placed closer to the antenna than to the electronic device, wherein the noise rejecting pattern is placed between a glass plate and an adhesive, wherein a length of the first conductor and a length of the second conductor are defined by Expression (3):

$$LA/(\alpha\times\beta)+LB/\alpha=n\times\lambda/2 \quad (3)$$

where LA represents the length of the first conductor, LB represents the length of the second conductor, $\lambda$ represents a wavelength of any one frequency selected from a desired noise rejection frequency band, a represents a wavelength shortening rate of the glass plate, $\beta$ represents a wavelength shortening rate of the adhesive, and n represents any natural number.

* * * * *